US006923302B2

(12) United States Patent
Godshaw et al.

(10) Patent No.: US 6,923,302 B2
(45) Date of Patent: Aug. 2, 2005

(54) LUGGAGE WITH VISUAL INSPECTION PANELS

(75) Inventors: Donald E. Godshaw, Evanston, IL (US); Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 10/621,550

(22) Filed: Jul. 17, 2003

(65) Prior Publication Data

US 2005/0011715 A1 Jan. 20, 2005

(51) Int. Cl.[7] ..... A45C 3/00

(52) U.S. Cl. ..... 190/109; 190/111; 190/113; 383/106

(58) Field of Search ..... 190/113, 109, 190/111; 383/106, 38, 117; 206/278, 773; 373/106

(56) References Cited

U.S. PATENT DOCUMENTS

| | | | | | |
|---|---|---|---|---|---|
| 2,603,266 | A | * | 7/1952 | Carroll | 150/112 |
| 3,530,961 | A | * | 9/1970 | Weissenbach | 190/111 |
| 3,807,537 | A | * | 4/1974 | O'Reilly | 190/121 |
| 3,861,504 | A | * | 1/1975 | McGraw | 190/110 |
| 4,022,261 | A | * | 5/1977 | Russell | 150/129 |
| 5,896,962 | A | * | 4/1999 | Smith et al. | 190/107 |
| 6,231,233 | B1 | * | 5/2001 | Orce | 383/38 |
| 6,237,660 | B1 | * | 5/2001 | Giardino | 150/105 |
| 6,286,462 | B1 | * | 9/2001 | Burns | 119/497 |
| 6,328,158 | B1 | * | 12/2001 | Bisbal et al. | 206/223 |
| 6,637,485 | B1 | * | 10/2003 | Sartena | 150/118 |

* cited by examiner

*Primary Examiner*—Sue A. Weaver
(74) *Attorney, Agent, or Firm*—Banner & Witcoff, Ltd.

(57) ABSTRACT

A luggage item interior may include various internal pockets. The outside face or material forming the luggage item is made from a clear plastic material covered by a removable opaque flap thereby providing ease of inspection of the contents of the luggage item from the outside thereof.

6 Claims, 2 Drawing Sheets

LUGGAGE WITH VISUAL INSPECTION PANELS

BACKGROUND OF THE INVENTION

In a principal aspect the present invention relates to luggage which includes interior pockets capable of having the contents thereof inspected externally from the luggage.

With the advent of significantly increased inspection and security measures, particularly at airports, there has developed the need for luggage which will facilitate such inspections. Governmental rules now mandate that any luggage which is checked onto an airline, for example, may not be locked in order that the luggage may be opened to enable the contents of the luggage to be easily inspected. Additionally carry-on luggage is subject to inspection.

Typically, luggage subject to inspection will include external flaps and pockets as well as multiple internal pockets with zipper or hook and loop (Velcro) fasteners. In order to inspect the contents of the pockets, the closures must be opened, the contents inspected, and then the closures reclosed. Such an inspection process causes significant delays of passengers and is a costly and time consuming undertaking. Thus, there has developed a need for luggage items which enhance the ability to conduct accurate, but speedy, inspections of luggage.

SUMMARY OF THE INVENTION

Briefly, the present invention comprises luggage and travel cases wherein the luggage or travel case includes various external fabric or opaque panels or flaps that maybe opened to reveal clear or transparent panels that permit visual access to and inspection of the interior of the luggage or case. The interior of luggage is not typically visually accessible from the exterior of the luggage. Rather, it is necessary to enter and inspect the interior contents of such luggage utilizing access through a zipper top opening, for example, and then subsequent access through additional fastener openings, such as zipper openings, to interior pockets within the luggage item. Thus, at least two zippers or other fastener mechanisms may require opening by an inspector in a circumstance wherein luggage does not incorporate the features of the present invention.

With the present invention, external opaque fabric flaps mounted on the outside of the luggage item cover clear or transparent flexible panels forming side and/or internal pockets in the luggage. Thus, panels made of polyvinyl chloride, or clear plastic material may be exposed by detaching the opaque cover flap from covering the clear plastic material which defines a side of the luggage to thereby enable easy inspection of the contents of the luggage. An inspector, who may desire to look in the various pockets within a luggage item, such as a backpack, carry-on duffel, or the like, may thereby have access to view the contents of the interior of the luggage item or as well as interior pockets by detaching the flexible opaque flap or cover which fits over clear plastic side or portion of the interior pocket of the luggage item.

Thus, it is an object of the invention to provide a luggage item which permits and facilitates inspection of the contents of the item without unzipping or opening every flap and/or side pocket within the interior of the bag or luggage item and without removing all of the contents of the item to gain access to the interior of the item.

A further object of the invention is to provide an economical, yet easily manufactured and cost effective design for a luggage item, particularly, a soft sided bag, backpack or duffel wherein opaque side access panels may be partially detached to reveal clear plastic panels forming a side of the interior and/or an interior pocket of the bag. The contents of the side pockets within the interior of the main bag may thus be easily accessed without removal of all of the items within the item. Rather, the materials within the side pockets on the interior of the luggage item will be exposed for a visual examination of the contents because of the utilization of clear plastic, e.g., polyvinyl chloride.

These and other objects, advantages and features of the invention will be set forth in the detailed description which follows.

BRIEF DESCRIPTION OF THE DRAWING

In the detailed description which follows, reference will be made to the drawings comprised of the following figures.

DESCRIPTION OF THE PREFERRED EMBODIMENT

Figure 1:
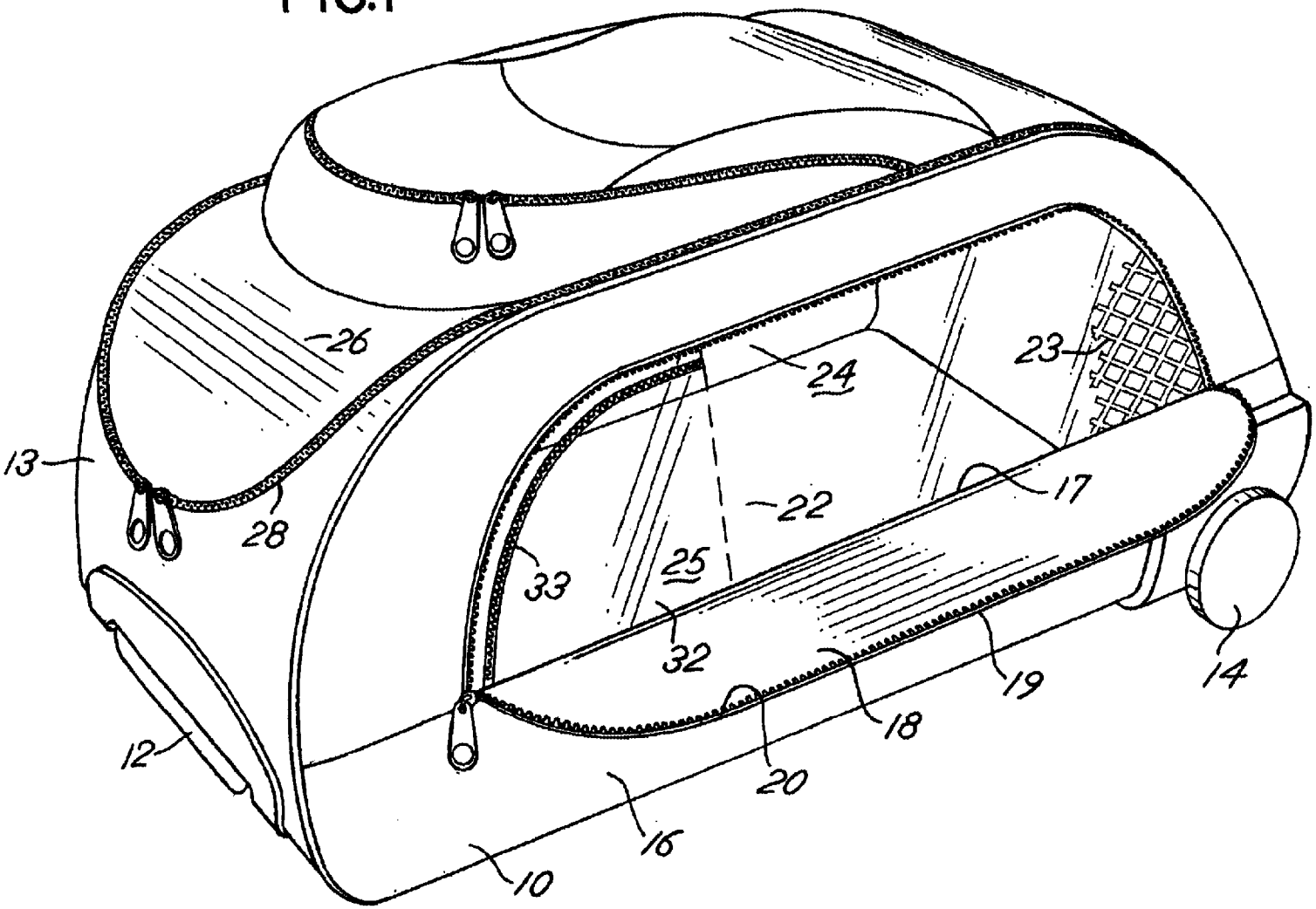
FIG. 1 is an isometric view of a first embodiment of the invention wherein a luggage item includes an outside clear or transparent panel which is generally covered by an auxiliary flap that fits over the clear panel.
Figure 2:
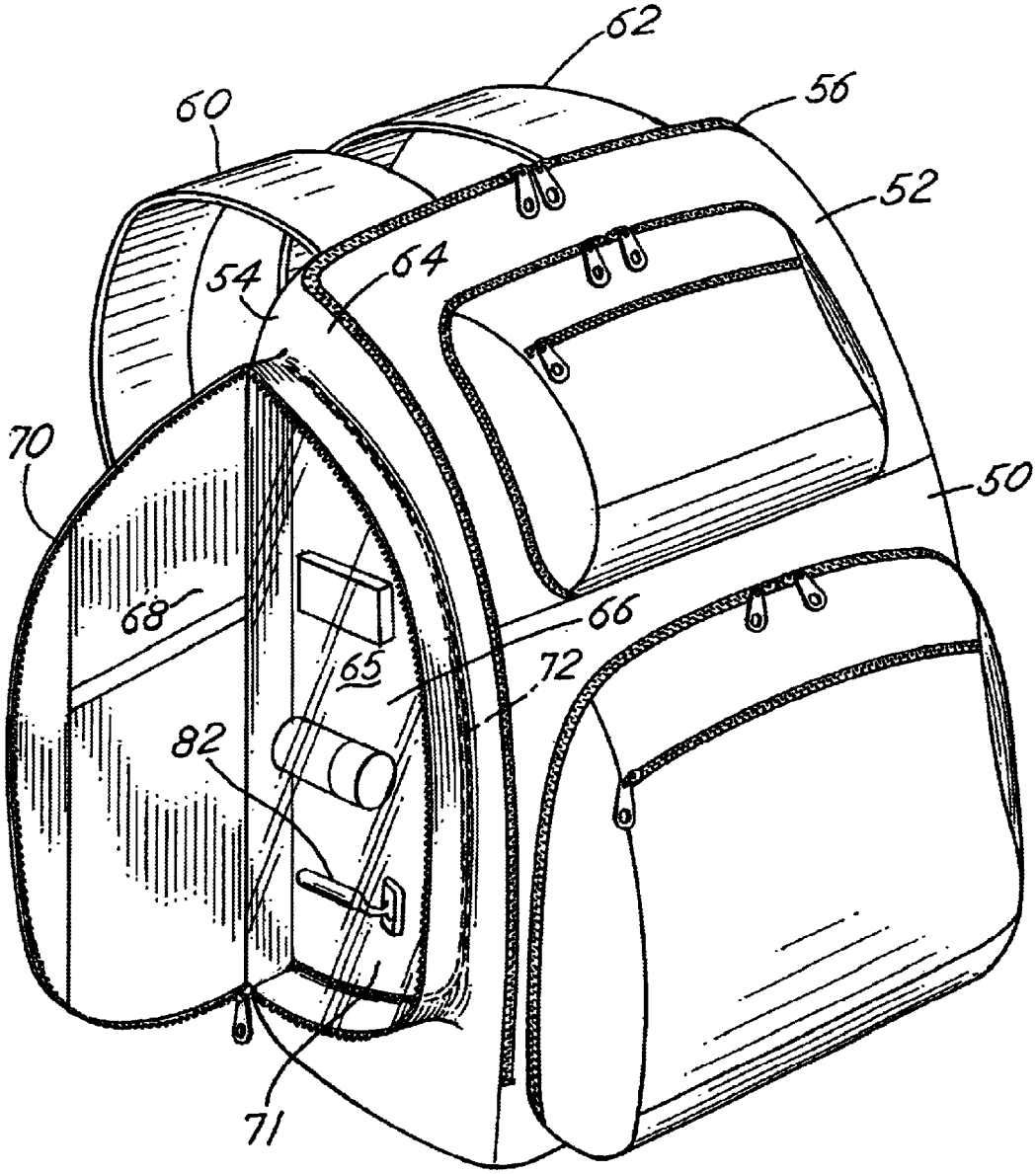
FIG. 2 is a luggage item in the form of a backpack which includes a clear side wall for an interior pocket within the backpack and further includes a protective flap which fits over the clear transparent side wall for the interior pocket within the backpack.

The luggage item of the invention may be in the form of a wheeled travel case, a backpack, or any other type of luggage item. Preferably, the invention is incorporated into soft sided luggage items of the type which comprise a bag typically with one side of the bag in the form of a rigid or semi-rigid board to which flexible fabric is attached to define the bag enclosure. The bag generally includes a top or side opening, for example, accessible by means of a zipper. Thus, all of the sides of the bag, or luggage item which form an external enclosure for the contents, will be opaque. For example, FIG. 1 depicts a wheeled travel bag. FIG. 2 illustrates a backpack. Each of the luggage items depicted in FIGS. 1 and 2 incorporate the features of the invention; namely, a transparent side wall covered by an opaque side wall is provided. Thus, a transparent side wall is provided to permit a view of the interior or interior pockets within the luggage item or bag. An opaque flap is incorporated on the outside of the luggage item to cover the transparent section or window. The opaque flap is generally flexible and is attached to the luggage item by means of a zipper or other fastening means. The flap typically covers only the transparent panel or section of the bag. Opening the flap to reveal the contents of the pocket in the bag facilitates inspection procedures at airports and other transportation centers inasmuch as the contents of the luggage may be separately, visually inspected.

Referring to FIG. 1, a bag 10 includes an extensible or telescoping handle 12 from the top panel or top end 13. Caddy wheels 14 are provided at the lower or bottom end of the bag 10. The bag 10 further includes a full side panel 16 with a flexible flap 18 having a zipper fastener 20 incorporated in the side 16.

The flap 18 is fabricated from an opaque, flexible material and covers, in a preferred embodiment, at least one-half (50%) of side panel 16. An elongate straight line seam 17 comprises a flexible hinge for flap 18. Zipper fastener 20 connects the remaining entire peripheral edge 19 of flap 18 to the side panel 16. The bag 10 further includes a transparent, polyvinyl chloride, flexible plastic panel 22 which forms or defines one portion 24 of one side 16 of the bag 10. The panel 22 may be fully transparent or may be imprinted with a pattern that will enable partial transparency. For example, the panel 22 may include a mesh pattern 23 imprinted thereon which still permits visual inspection of the contents of inside 25 of the bag 10. Further, interior panels within the bag 10 defining internal pockets may be fashioned of transparent or mainly transparent material to permit visual access to the interior of the bag 10. For example, the interior pocket panel 32 which is accessible by means of a zipper closure 33 in the interior of the bag 10 may be made from a transparent or principally transparent material such as a plastic sheet material. Visual inspection of the pocket 32 contents as well as the inside 25 of the bag 10 may then occur by unzipping the flap 18 in side panel 16.

The inside 25 of the bag 10 is physically accessible by opening of a front flap 26. Thus, operating a zipper 28 will enable opening the flap 26 for access to the interior 24 of the bag 10. Such physical access can take place if the visual inspection via a side panel flap 18 is unsatisfactory.

FIG. 2 illustrates an alternative embodiment of the invention as incorporated in a backpack. In the backpack 50, a large front flap 52 is attached to the main bag or body 54 of the backpack by means of a zipper fastener 56. Detaching or unzipping the zipper fastener 56 will enable the flap 52 to be totally opened for access to the interior of the backpack 50. Backpack straps 60 and 62 are provided on the back side of the backpack.

A side panel 64 includes a transparent polyvinyl chloride plastic panel 66 defining the side 64, at least in part. The transparent panel 66 has associated therewith a foldable cover flap 68 which is attached to the side panel 64 by means of a zipper 70. In this manner, the flap 68 may be folded to cover the polyvinyl chloride, clear, transparent panel 66 forming a part of the side panel 64 of the backpack 50.

The backpack 50 further includes an inside opaque panel 71 which defines at least part of the interior of a pocket or pouch 65 formed by the transparent panel 66 and the opaque panel 71. An internal zipper 72 is provided for access to the internal pouch 65 from the inside of the backpack. Contents within the interior pocket 65 within the backpack such as a razor 82 and other items such as toiletries within the pocket 65 may be viewed merely by unzipping or detaching the foldable flap 68. In this manner, an inspector investigating the backpack and the contents thereof may detach the zipper 56 to generally look into the interior of the backpack and view the contents thereof. A side pocket 65 within the backpack may be viewed by releasing the flap 68 so that the contents of the associated pouch 65 can be viewed easily through the transparent side panel 66. Of course, the opaque panel 71 may be transparent in whole or in part so that the contents of the backpack may be viewed upon lifting flap 68.

Various combinations and permutations of the invention are possible and still reside within the scope and meaning of the claims. For example, a number of such "windows" to the interior pockets of the luggage or bag may be provided. Importantly, each of the interior pockets is formed with a generally transparent flexible plastic, polyvinyl chloride outside wall. The transparent panel may form a side of the backpack as well as a side of the interior pockets within the backpack thereby enabling ease of inspection of the contents of those pockets without unzipping all of the interior pockets and without disturbing the other contents within the backpack which may already have been inspected. Thus, the number and placement of the transparent sections or portions of the luggage item may be varied. Also, numerous interior pockets may be viewed through a single transparent outside panel wall. The size, shape and material used to form the clear transparent panel may be varied. Note that the combination of the panel along with a flap as described enhances the structural integrity of the luggage item as well as providing a means whereby the contents of internal pockets within the luggage item or the interior of the luggage item or bag may be easily inspected. Also, the visual inspection panels are preferably provided in side panels of luggage, but may be provided in any other panel and for individual pouches of the luggage.

Thus, though preferred embodiments of the invention are disclosed, it is to be understood that the invention is to be limited only by the following claims and equivalents thereof.

What is claimed is:

1. Luggage comprising, in combination:

an enclosed bag, said bag including an interior enclosure and a side wall, said side wall including a transparent panel with an inside and outside;

said bag further including an opaque panel within the interior enclosure of the bag fastened to the side wall and covering the inside of the transparent panel, said opaque panel providing an interior pocket within the bag interior enclosure for retention of items therein, an ingress opening in the opaque pocket panel for access to the interior of the pocket, a fastener for closure of the ingress opening of the pocket;

a foldable opaque cover flap affixed to the side wall for covering the outside of the transparent panel, said cover flap including a peripheral edge section detachable from the side wall, a flap fastener on the peripheral edge section for attachment of the flap to the side wall and for detachment of said flap from said side wall to expose the transparent panel to thereby permit visual observation of contents of the interior pocket through the transparent panel;

a bag opening for access to the interior enclosure of the bag and access to the fastener for the interior pocket; and a bag fastener for closure of the bag opening.

2. The luggage of claim 1 wherein the fasteners are zippers.

3. The luggage of claim 1 wherein the bag is in the form of a backpack and includes at least one external carry strap.

4. Luggage comprising, in combination:

an enclosed bag, said bag including an interior enclosure and a side wall, said side wall including a transparent panel forming a portion of the side wall, said transparent panel including an inside and an outside;

said bag further including a pocket forming panel within the interior enclosure of the bag fastened to the side wall and covering the inside of the transparent panel, said pocket forming panel providing an enclosed interior pocket within the bag interior enclosure for retention of items therein, said pocket forming panel further including an ingress opening for access to the enclosed interior pocket;

a pocket fastener for closure of the pocket forming panel ingress opening;

a foldable material, opaque cover flap affixed to the side wall for covering the outside of the transparent panel, said cover flap including a peripheral edge section detachable from and attachable to the side wall for revealing and for covering, respectively, the transparent panel to thereby permit and prevent, respectively, visual inspection of the contents of the interior pocket through the transparent panel;

a bag opening to the interior enclosure of the bag and for access to the pocket fastener from the exterior of the pocket; and a bag fastener for closure of the bag opening.

5. The luggage of claim 4 wherein the pocket forming panel is, at least in part, substantially transparent.

6. The luggage item of claim 4 wherein the fasteners are zippers.

* * * * *